US008434556B2

(12) United States Patent
Jamaluddin et al.

(10) Patent No.: US 8,434,556 B2
(45) Date of Patent: May 7, 2013

(54) APPARATUS AND METHODS FOR REMOVING MERCURY FROM FORMATION EFFLUENTS

(75) Inventors: Abul K. M. Jamaluddin, Kuala Lumpar (MY); Raymond J. Tibbles, Kuala Lumpar (MY)

(73) Assignee: Schlumberger Technology Corporation, Sugar Land, TX (US)

( * ) Notice: Subject to any disclaimer, the term of this patent is extended or adjusted under 35 U.S.C. 154(b) by 292 days.

(21) Appl. No.: 12/761,755

(22) Filed: Apr. 16, 2010

(65) Prior Publication Data

US 2011/0253375 A1 Oct. 20, 2011

(51) Int. Cl.
*E21B 43/34* (2006.01)
*E21B 37/08* (2006.01)

(52) U.S. Cl.
USPC ..... 166/310; 166/228; 166/241.6; 166/242.4; 166/265; 166/276

(58) Field of Classification Search ..... None
See application file for complete search history.

(56) References Cited

U.S. PATENT DOCUMENTS 4,717,399 A * 1/1988 Audeh ..... 95/134
5,141,724 A 8/1992 Audeh et al.
5,284,048 A * 2/1994 Horner ..... 73/49.2
5,460,643 A 10/1995 Hasenpusch et al.
5,597,729 A 1/1997 Easterly et al.
5,851,389 A 12/1998 Brewster et al.
6,383,981 B1 5/2002 Blankenship et al.
6,447,577 B1 * 9/2002 Espin et al. ..... 95/136
6,537,444 B2 3/2003 Wilberscheid et al.
7,424,915 B2 9/2008 Vinegar
2004/0023018 A1 * 2/2004 Farha et al. ..... 428/312.2

OTHER PUBLICATIONS

International Search Report and Written Opinion of PCT Application Serial No. PCT/US2011/029764 dated Dec. 20, 2011.
Hsi et al., "Mercury Adsorption Properties of Sulfur-Impregnated Adsorbents," Journal of Environmental Engineering, Nov. 2002, vol. 128(11): pp. 1080-1089.
Li et al., "Importance of activated carbon's oxygen surface functional groups on elemental mercury adsorption," Fuel, 2003, vol. 82(4): pp. 451-457.
Manchester et al., "High capacity mercury adsorption on freshly ozone-treated carbon surfaces," Carbon N. Y., NIH Public Access, Mar. 2008, vol. 46(3): pp. 518-524.
Mishra et al., "Inorganic particulates in removal of heavy metal toxic ions—Part X: Rapid and efficient removal of Hg (II) ions from aqueous solutions by hydrous ferric and hydrous tungsten oxides," Journal of Colloid and Interface Science, 2006, vol. 296: pp. 383-388.
Oekon et al., "Operating History of Arun Liquefied Natural Gas Plant," SPE 12456, Journal of Petroleum Technology, May 1985: pp. 863-867.
Nutavoot Pongsiri, "Initiatives on Mercury," SPE Prod. & Facilities, Feb. 1999, vol. 14(1): pp. 17-20.

* cited by examiner

*Primary Examiner* — Zakiya W Bates

(57) ABSTRACT

An apparatus and related methods for removing hazardous trace elements from hydrocarbon reservoir effluent is implemented by placing an adsorbing volume of material designed to adsorb the hazardous trace elements into the vicinity of a producing formation face at a downhole location; and letting the reservoir effluent flow through the volume of adsorbing material.

14 Claims, 5 Drawing Sheets

APPARATUS AND METHODS FOR REMOVING MERCURY FROM FORMATION EFFLUENTS

FIELD OF THE INVENTION

The invention relates to apparatus and methods for removing mercury from formation effluents such as liquid and gaseous hydrocarbons and water.

BACKGROUND

The production of hydrocarbon fluids from subterranean reservoirs through wells drilled into the formation often results in the inadvertent production of contaminants or trace elements washed out of the formation by the production flow. Mercury, in particular, is known as a contaminant of hydrocarbon production in many geographical areas.

The typical concentrations of mercury in the gas phase production streams ranges from 50 to 180 micro gram/standard cubic meter of gas. In liquid phase production the level of concentrations of mercury varies typically from 10 to 1000 parts per billion (ppb). In the known reservoirs mercury occurs predominantly in elemental form. It can also be found in ionic form or as an organic compound.

When present in sufficient concentration, the contaminated production becomes unsuitable as feed flow for downstream refineries and the contaminant has to be removed before entering the refining process. The various known mercury removal processes can be categorized in accordance with the underlying principle used in the process as:

1) Chemical
   a. Extraction method
   b. Absorption/Complexation
   c. Ion exchange
   d. Precipitation
   e. Reduction
2) Physical
   a. Filtration
   b. Flocculation/Agglomeration
   c. Adsorption
   d. Molecular Sieve
   e. Membrane Separation
3) Mechanical
   a. Cyclone—Centrifugation
4) Biological
   a. Plant—Phytoremediation
   b. Bacteria
   c. Enzyme—bioremediation The above listed apparatus and methods are described in many documents including:

(1) Oekon, J. R. & Suyanto, P. T.: "Operating History of Arun Liquefied Natural Gas Plant," SPE 12456, Journal of Petroleum Technology, May 1985, 863-867.
(2) Pongsiri, N.: "Initiatives on Mercury," SPE Prod. & Facilities 14 (1), February 1999.
(3) Manchester, S. Wang, X., Kulaots, I. & Hurt, R. H.: "High Capacity Mercury Adsorption on Freshly Ozone-Treated Carbon," NIH Public Access, PMC 2009, March 1.
(4) Mishra, S. P. & Vijaya,: "Inorganic Particulates in Removal of Heavy Metal Toxic Ions—Part X: Rapid and Efficient Removal of Hg (II) ions from Aqueous Solutions by Hydrous Ferric and Hydrous Tungsten Oxides," Journal of Colloid Science 296 (2006) 383-388.
(5) Hsi, H. C., Rood, M. J., Abadi, M. R., Chen, S. & Chang, R.: "Mercury Adsorption Properties of Sulfur-Impregnated Adsorbents," Journal of Environmental Engineering 128 (11) (Nov 2002) 1080-1089.
(6) Easterly L. A., Vass, A. A., Tyndall, R. L.: "Method for removal and recovery of Mercury". U.S. Pat. No. 5,597, 729, 1997.
(7) Li, Y. H., Lee, C. W., Gullett, B. K.,: Importance of Activated Carbon's Oxygen Surface Functional Groups on Elemental Mercury Adsorption." Fuel, 2003; 82 (4) 451-457 as well as the U.S. Pat. No. 6,537,444 to T. C. Frankiewicz and J. Gerlach and U.S. Pat. No. 5,460,643 to W. Hasenpusch and H. Wetterich among many others Given that mercury can have a corrosive effect on tubing and other subterranean and surface production installation well before reaching any refinery, the known methods of scrubbing or removing it from the produced flow of hydrocarbon at the point of entry to the refining process can be regarded as a problem. In the light of these corrosive and other adverse effects on the operation of production installations in boreholes and the surface, it is seen as an object of the present invention to provide tools and methods to remove mercury as early as possible from the production stream.

SUMMARY OF INVENTION

Hence according to a first aspect of the invention there is provided an apparatus and related methods for removing hazardous trace elements from hydrocarbon reservoir effluent by placing an adsorbing volume of material designed to adsorb the hazardous trace elements into the vicinity of a producing formation face at a downhole location; and letting said reservoir effluent flow through said volume of adsorbing material.

In a preferred embodiment, the trace element is mercury.

In a variant of the invention apparatus the adsorbing volume is a coating or layer applied to parts of downhole tubing or screens. Alternatively, the adsorbing volume is solid body or a volume of granular material confined by downhole tubing or screens. It can be placed between the face of the formation and sand screen or gravel packs or as part of a sand or gravel pack or behind (when looking in direction of the production flow) such a sand screen or gravel pack.

In a preferred embodiment of the invention, the adsorbing volume can be regenerated to restore adsorbing properties. This is best achieved through a flushing treatment from the surface or by retrieving the adsorbing material.

These and other aspects of the invention are described in greater detail below making reference to the following drawings.

DETAILED DESCRIPTION

Whilst many among the above listed known methods for removing trace elements, e.g. based on chemical, physical, mechanical or biological processes, may be applied in a form suitable for placement with a subterranean hydrocarbon producing well, the following examples are use known mercury adsorbing materials in various forms. The aim of these examples is to place the removal or scrubbing process as close as possible to the location where the producing face of the reservoir formation meets the completion installation.

Figure 1:
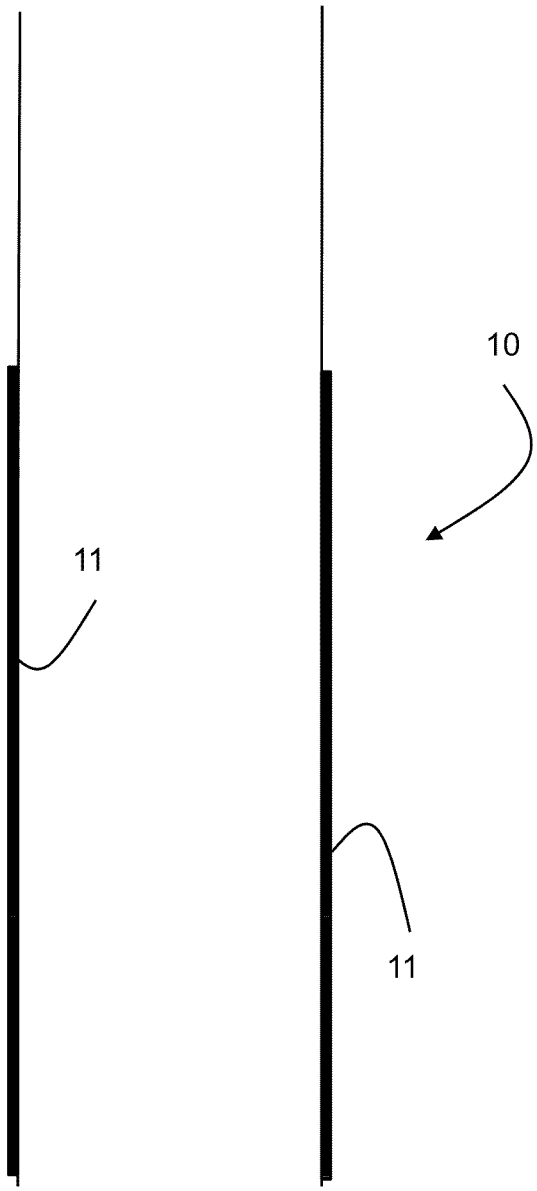
FIGS. 1-4 show examples in accordance with the invention in a schematic view and in various cross-sections.

The first example as shown in FIG. 1. illustrates schematically a section of tubing 10 for downhole installation at least partially coated with mercury adsorbing materials 11. The adsorbing material used in the example can be selected from a variety of known materials such as 1) Sulfur impregnated activated carbon (sulfur impregnation can have adsorption capacity of 4,509 micro gram/gram of adsorbent).
2) Silver impregnated molecular sieve
3) Metals like copper oxides/sulfides
4) Ozone-treated carbon surface (mercury adsorption capacity of carbon increases by a factor of 134)
5) Hydrous Ferric oxide (HFO) and hydrous tungsten oxide (HTO)
6) Nanoparticles and other materials as for example referred to in the above cited documents.

In FIG. 1 a part of a slotted liner 10 which itself is the bottom part of a well bore production installation is shown covered with a porous coating of sulfur impregnated activated carbon 11. The particles are embedded in a thin layer of hardened epoxy to withstand the downhole installation process and the pressure and temperature at the downhole location. As the production flow passes through and along the coated section, mercury is adsorbed and immobilized within the matrix of the adsorbing material 11. The material can be regenerated using a flushing treatment from the surface or by removing and/or re-coating the installation using for example one or a combination of the methods described below.

Other parts of the known subterranean well installation, such as piping, casing, screen, slotted liners, can be similarly treated either prior to installation or after being installed as a variant of the known downhole remedial treatment in which in which for example the coating material is pumped downhole and hardens on exposed surfaces. For an installation prior to the downhole deployment, the coating may be further protected by a sacrificial layer of polymeric material or wax which is allowed to dissipate under downhole conditions following the installation.

Figure 2:
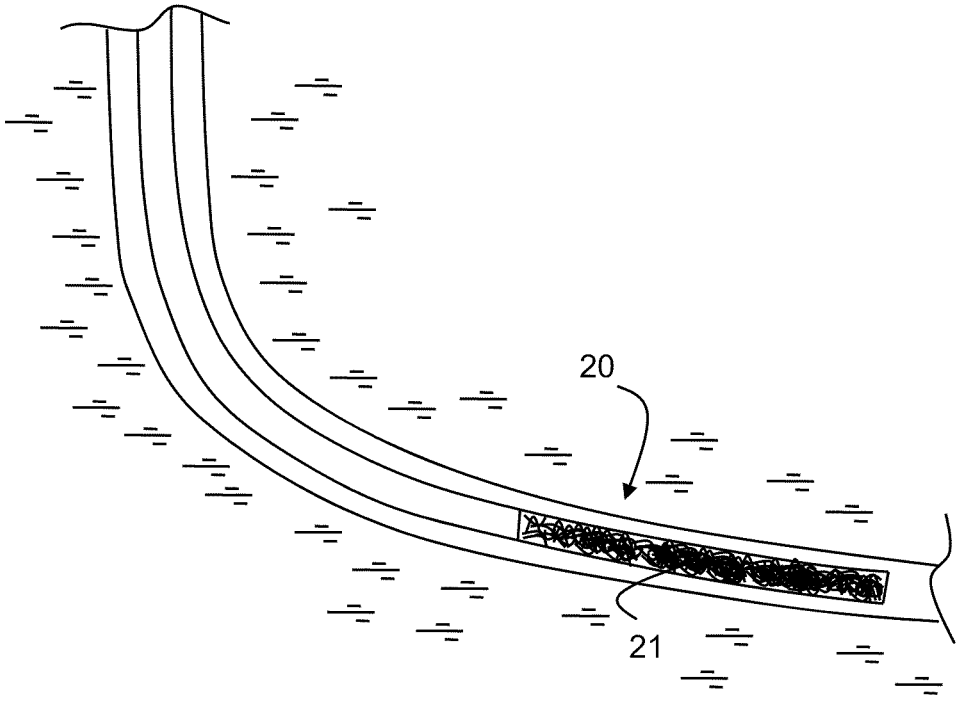

Another example of the present invention is shown in FIG. 2. The figure shows in a schematic manner a section of the subterranean completion 20. The section shown is filled with an absorbing material 21 enclosed within a meshed container to prevent it from migrating downstream with the production flow. The section 20 is designed to be (periodically) removeable from the well in order to be able to either replace or regenerate the absorbing material 21.

Figure 3A:
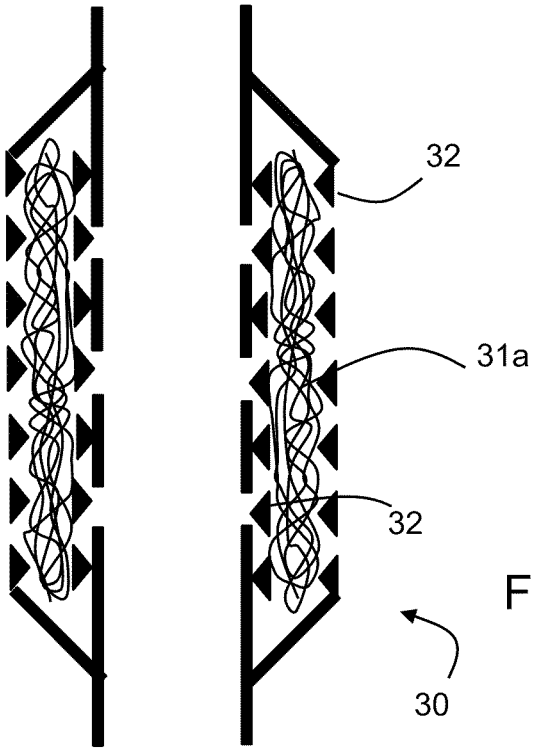
Figure 3B:
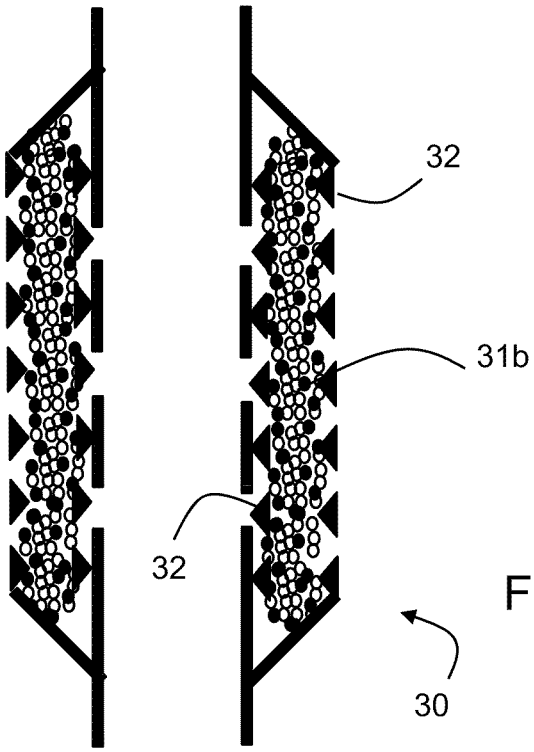

In further examples, the adsorbing materials 31 in enclosed within one or more slotted or meshed-wire compartments 32 mounted onto well tubing 30 at the reservoir face. FIG. 3A shows such a compartment filled with an adsorbing fibrous material 31*a*, whereas in FIG. 3B the compartment is filled with a mixture of gravel or sand and particles of activated carbon or adsorbing ceramic particles 31*b*. The installation of such screens is identical to the placement of conventional pre-packed screens.

Figure 4:
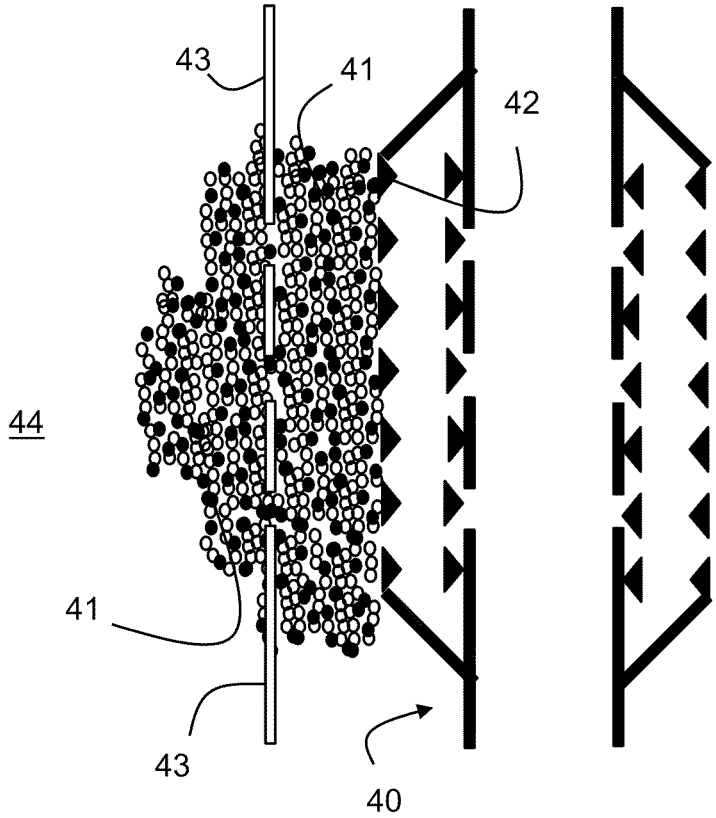

However the adsorbing material can also be combined with a gravel or sand pack or, alternatively, replace such a pack. FIG. 4 shows the adsorbing material 41 placed into the annulus between the completion tubing 40 with a supporting screen 42 and the casing 43, filling perforations and fractures in the formation 44. A similar approach can be used in an open hole environment where the casing 43 would not be present.

In the event the adsorbing material described above approaches saturation or is found to be contaminated, it can be regenerated by a number of different methods, including 1) Mercury solubilizing chemical injection into the sandface region, including soaking the sandface equipment for a pre-designed time and producing back the chemical, treating and disposing the mercury saturated medium in a controlled environment; or
2) introducing thermal heating/cooling to release the mercury from the completion string and recovering, treating and disposing the mercury saturated medium in a controlled environment.

These proposed methods have the advantage of regenerating the adsorbing material at the downhole location, thereby avoiding the need to remove the well tubing.

Figure 5:
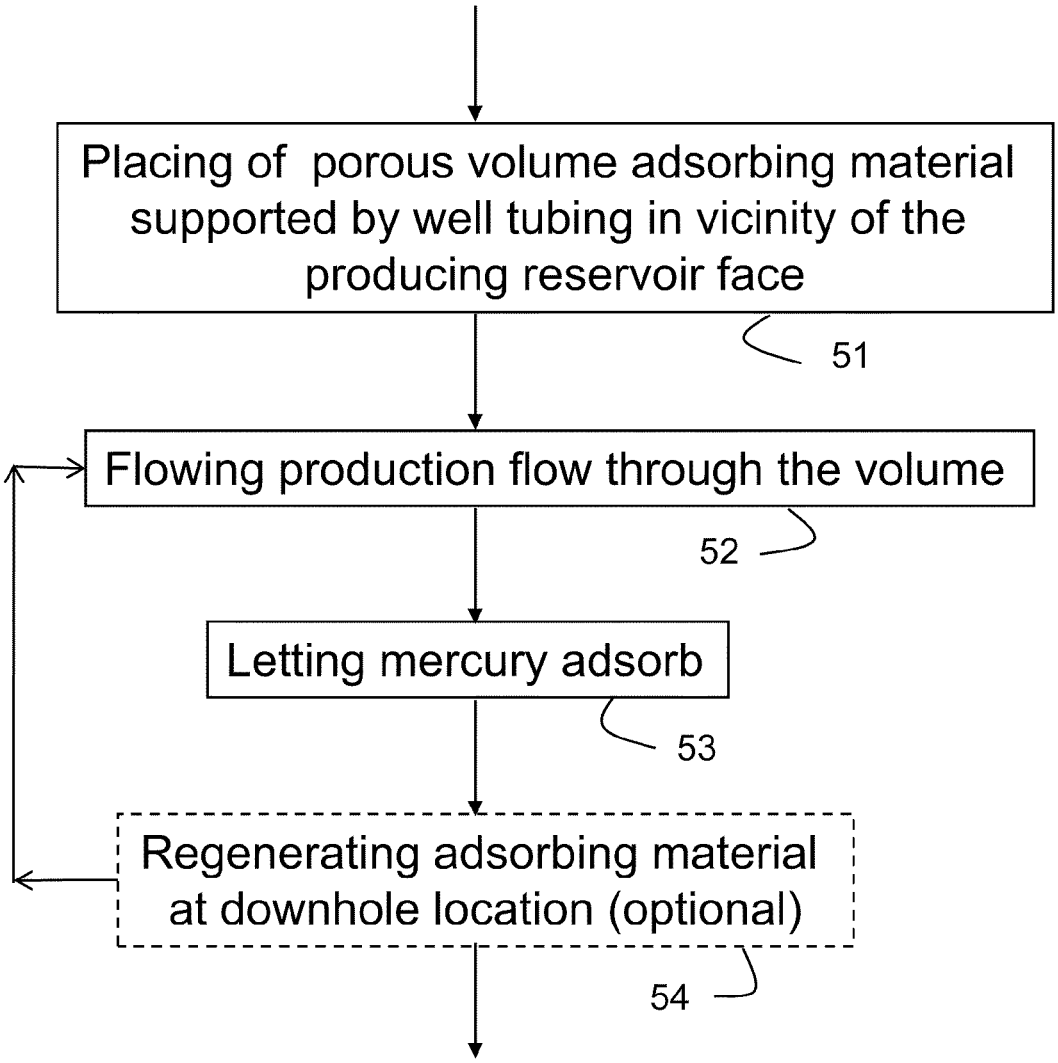
FIG. 5 is a flowchart illustrating steps in accordance with an example of the invention.

A flow chart of steps in accordance with an example of the invention is shown in FIG. 5. The method includes the step 51 of initially placing a porous volume of adsorbing material supported by well tubing in vicinity of the producing rock face. Then the production flow is allowed to pass through or along the absorbing material (Step 52) and mercury is removed from it (Step 53). The material may be regenerated in an optional step 54 before continuing the process. However depending on the concentration of the trace element and capacity of the absorbing material, it can be calculated that in most cases the initial amount of adsorbing material remains effective for years.

Moreover, while the preferred embodiments are described in connection with various illustrative apparatus and methods, one skilled in the art will recognize that the apparatus and methods may be embodied using a variety of specific procedures and equipment. Accordingly, the invention should not be viewed as limited except by the scope of the appended claims.

What is claimed is:

1. A method of removing hazardous trace elements from hydrocarbon reservoir effluent, comprising the steps of placing a porous volume of material designed to adsorb the hazardous trace elements into the vicinity of a producing formation face at a downhole location; and letting the reservoir effluent flow through the volume of adsorbing material;

wherein the adsorbing material is suitable for downhole regeneration.

2. A method in accordance with claim 1, wherein trace element is mercury.

3. A method in accordance with claim 1, wherein the adsorbing material is selected from group consisting of sulfur impregnated activated carbon, silver impregnated molecular sieves, copper oxides, copper sulfides, ozone-treated carbon surface, hydrous ferric oxide (HFO), hydrous tungsten oxide (HTO) and other adsorbing nanoparticles.

4. A method in accordance with claim 1, further comprising the step of flushing the adsorbing material with a regenerating agent.

5. A method in accordance with claim 4, wherein the regenerating agent comprises a heated fluid at a temperature above reservoir temperature.

6. A method in accordance with claim 4, wherein the regenerating agent comprises a chemical active component to bind the adsorbed trace elements.

7. An apparatus for removing hazardous trace elements from hydrocarbon reservoir effluent comprising a section of well tubing designed to be placed inside a well penetrating a hydrocarbon bearing formation, wherein the section supports a porous volume of material to adsorb the hazardous trace elements, wherein the apparatus is configured to allow downhole regeneration of the material to adsorb the hazardous trace elements.

8. The apparatus of claim 7, wherein the hazardous trace element is mercury.

9. The apparatus of claim 7, wherein the section of well tubing is a slotted liner or a sieved or meshed-wire screen.

10. The apparatus of claim 7, wherein the adsorbing material is selected from group consisting of sulfur impregnated activated carbon, silver impregnated molecular sieves, copper oxides, copper sulfides, ozone-treated carbon surface, hydrous ferric oxide (HFO), hydrous tungsten oxide (HTO) and other adsorbing nanoparticles.

11. A method for regenerating a material in a wellbore that adsorbs a heavy metal from a hydrocarbon reservoir effluent, comprising:

stopping a flow of hydrocarbon effluent in contact with the material;

flushing the material with a regenerating agent; and allowing the hydrocarbon effluent to flow through or over the regenerated material.

12. The method of claim 11, wherein the flushing step is performed with the regenerating agent heated to a temperature above a reservoir temperature.

13. The method of claim 11, wherein the regenerating agent is a chemical active component that will bind with an adsorbed heavy metal.

14. The method of claim 11, where in the heavy metal is mercury.

* * * * *